US006705134B2

(12) United States Patent
Miranda

(10) Patent No.: US 6,705,134 B2
(45) Date of Patent: Mar. 16, 2004

(54) PADLOCK ASSEMBLY

(76) Inventor: Richard Miranda, 41 Jackson Ave., Elmont, NY (US) 11003

( * ) Notice: Subject to any disclaimer, the term of this patent is extended or adjusted under 35 U.S.C. 154(b) by 0 days.

(21) Appl. No.: 10/231,856

(22) Filed: Aug. 30, 2002

(65) Prior Publication Data

US 2003/0182978 A1 Oct. 2, 2003

Related U.S. Application Data

(60) Provisional application No. 60/367,531, filed on Mar. 26, 2002.

(51) Int. Cl.[7] ..... E05B 67/02; E05B 67/38

(52) U.S. Cl. ..... 70/52; 70/55; 70/56; 70/417

(58) Field of Search ..... 70/50–56, DIG. 43, 70/DIG. 56, 417, 30, 49, 38 R, 38 A, 38 B, 38 C, 39

(56) References Cited

U.S. PATENT DOCUMENTS

| | | | | | |
|---|---|---|---|---|---|
| 194,849 | A | * | 9/1877 | Smith et al. | |
| 218,200 | A | | 8/1879 | Taylor | |
| 405,329 | A | | 6/1889 | Smith | |
| 786,586 | A | | 4/1905 | Moreland | |
| 1,246,287 | A | * | 11/1917 | Lemon | |
| 1,512,589 | A | * | 10/1924 | Freysinger | |
| 1,734,153 | A | * | 11/1929 | Bate | |
| 1,835,709 | A | | 12/1931 | Jacobi | |
| 2,259,271 | A | | 10/1941 | Seay, Jr. | |
| 2,330,765 | A | | 9/1943 | Voight | |
| 2,370,991 | A | | 3/1945 | Ohno | |
| 2,379,437 | A | | 7/1945 | Hines et al. | |
| 2,395,762 | A | | 2/1946 | Rober | |
| 2,893,232 | A | | 7/1959 | Foote et al. | |
| 3,453,758 | A | | 7/1969 | Soref et al. | 40/21 |
| 3,695,067 | A | * | 10/1972 | Bays | 70/63 |
| 3,765,197 | A | * | 10/1973 | Foote | 70/58 |
| 3,768,137 | A | | 10/1973 | Russell | 29/238 |
| 3,835,675 | A | | 9/1974 | Lippisch | 70/38 A |
| 3,835,676 | A | | 9/1974 | Foote | 70/52 |
| 3,848,440 | A | | 11/1974 | Manuel | 70/55 |
| 3,855,824 | A | * | 12/1974 | Falk | 70/38 A |
| 3,858,419 | A | | 1/1975 | Hampton | 70/55 |
| 3,952,560 | A | | 4/1976 | Lee | 70/52 |
| 3,983,725 | A | | 10/1976 | Manuel et al. | 70/55 |
| 4,047,407 | A | | 9/1977 | Aranzabal | 70/52 |
| 4,183,235 | A | * | 1/1980 | Coralli et al. | 70/34 |
| 4,224,813 | A | | 9/1980 | Hampton | 70/51 |
| 4,226,100 | A | | 10/1980 | Hampton et al. | 70/51 |
| 4,238,941 | A | * | 12/1980 | Halopoff | 70/56 |
| 4,286,445 | A | | 9/1981 | Sills | 70/55 |
| 4,297,861 | A | | 11/1981 | Dykes | 70/55 |

(List continued on next page.)

FOREIGN PATENT DOCUMENTS

| | | | | |
|---|---|---|---|---|
| AT | 45610 | * | 1/1911 | 70/55 |
| DE | 286167 | * | 7/1915 | 70/52 |
| GB | 212858 | * | 3/1924 | 70/52 |
| GB | 583744 | * | 12/1946 | 70/52 |
| GB | 1205190 | * | 9/1970 | 70/53 |

*Primary Examiner*—Lloyd A. Gall
(74) *Attorney, Agent, or Firm*—Kirkpatrick & Lockhart LLP

(57) ABSTRACT

A padlock assembly includes a padlock including a lock body and a shackle. The lock body has a top surface and a bottom surface and at least one body pin having a longitudinal dimension and extending through the lock body and beyond the top surface and the bottom surface. The shackle is fixedly attachable to the lock body through the top surface. The padlock assembly also includes a jacket having a hollow member shaped to receive the lock body and fixedly attached to the lock body. The jacket has a length at least as great as the longitudinal dimension of the at least one body pin and the jacket is disposed on the lock body to extend beyond the top surface and the bottom surface coextensive with the at least one body pin.

20 Claims, 5 Drawing Sheets

U.S. PATENT DOCUMENTS

| | | | | | |
|---|---|---|---|---|---|
| 4,464,915 | A | | 8/1984 | Moshe et al. | 70/52 |
| 4,567,740 | A | | 2/1986 | Kelly | 70/55 |
| 4,576,022 | A | | 3/1986 | Gamble | 70/55 |
| 4,689,975 | A | | 9/1987 | Dunphy et al. | 70/56 |
| 4,879,889 | A | * | 11/1989 | DeForrest, Sr. | 70/56 |
| 4,899,560 | A | | 2/1990 | Chen | 70/52 |
| 5,146,771 | A | | 9/1992 | Loughlin | 70/56 |
| 5,156,029 | A | | 10/1992 | Heald | 70/55 |
| 5,236,527 | A | | 8/1993 | Brodsky | 156/85 |
| D341,766 | S | | 11/1993 | Zacher et al. | D8/334 |
| 5,303,568 | A | | 4/1994 | Wightman | 70/56 |
| 5,394,711 | A | | 3/1995 | Pitkänen | 70/38 A |
| 5,587,702 | A | * | 12/1996 | Chadfield | 70/38 A X |
| D395,224 | S | | 6/1998 | Turner | D8/346 |
| 5,761,935 | A | | 6/1998 | Adelmeyer | 70/55 |
| D406,044 | S | | 2/1999 | Turner | D8/346 |
| 6,205,824 | B1 | | 3/2001 | Miao | 70/58 |
| D442,059 | S | | 5/2001 | Turner | D8/346 |
| 6,305,198 | B1 | * | 10/2001 | Chastain et al. | 70/40 |
| 6,405,569 | B1 | | 6/2002 | Kite | 70/14 |
| 6,539,754 | B1 | * | 4/2003 | Fang | 70/52 |

* cited by examiner

PADLOCK ASSEMBLY

CROSS REFERENCE TO RELATED APPLICATIONS

This application claims priority under 35 U.S.C. § 119(e) to U.S. provisional patent application Serial No. 60/367,531, filed Mar. 26, 2002.

SUMMARY

An embodiment of the present invention relates to a padlock assembly that includes a padlock including a lock body and a shackle. The lock body has a top surface and a bottom surface and at least one body pin having a longitudinal dimension and extending through the lock body and beyond the top surface and the bottom surface. The shackle is fixedly attachable to the lock body through the top surface. The padlock assembly also includes a jacket comprising a hollow member shaped to receive the lock body and fixedly attached to the lock body. The jacket has a length at least as great as the longitudinal dimension of the at least one body pin, and the jacket is disposed on the lock body to extend beyond the top surface and the bottom surface coextensive with the at least one body pin.

Another embodiment of the present invention relates to a padlock that includes a lock body and a shackle fixedly attachable to the lock body. The lock body has a surface that includes a perimeter flange having an edge. At least one body pin extends through the lock body and beyond the surface but not beyond the edge of the perimeter flange.

DESCRIPTION OF THE FIGURES

For the present invention to be understood clearly and readily practiced, the present invention will be described in conjunction with the following figures, wherein.

DESCRIPTION

The present invention relates to a padlock assembly. The invention includes a security jacket made, e.g., from hardened steel, for protecting a shackle or flexible cable padlock and, more particularly, for preventing access to the body pins of the padlock. The term "shackle," as used herein, refers to any flexible cable, chain or U-shaped member known in the art. According to one embodiment, the security jacket fits over the body portion of the padlock and extends beyond the top and/or bottom faces of the padlock body to prevent access to the body pins.

Figure 1:
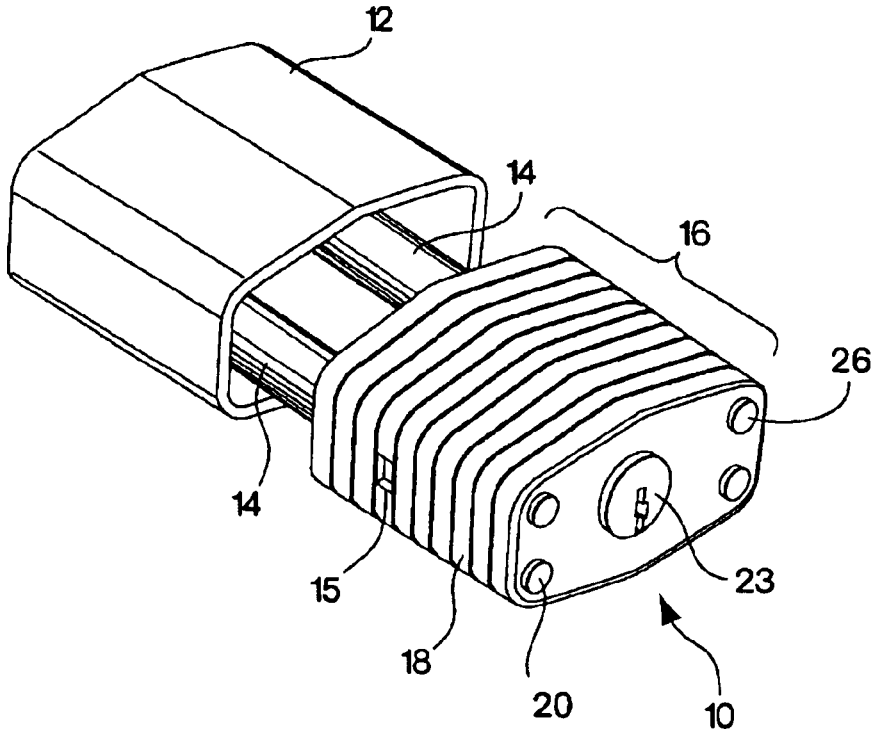
FIG. 1 is an isometric diagram that illustrates a padlock with a security jacket partially removed according to an embodiment of the present invention.

FIG. 1 illustrates a padlock 10 with a security jacket 12 partially removed. The padlock 10 includes a shackle or flexible cable 14, shown partially obstructed, a locking cavity 15, and a padlock body portion 16 that has a top face 22 (not visible) and a bottom face 23. Locking cavity 15 is a prefabricated recess on the surface of body portion 16 that may be used to permanently secure jacket 12 to padlock 10 either alone or in combination with other securing means. In particular, jacket 12 may be crimped or punched inwardly when jacket 12 is in place on padlock 10, causing swaged metal of the jacket to flow or move into locking cavity 15. Body portion 16 includes of a plurality of body plates 18 secured by a plurality of cylindrical body pins 20 that penetrate and extend through body plates 18. Body pins 20 have a longitudinal dimension or length that corresponds to the longitudinal dimension of the padlock between the top and bottom faces. Body pins 20 have proximal ends 24 that extend slightly beyond top face 22 and distal ends 26 that extend slightly beyond bottom face 23.

Jacket 12 is constructed of a high impact material, e.g., hardened steel, to suitably protect body plates 18 and body pins 20, which otherwise may be vulnerable to a forced attack. Accordingly, jacket 12 is sized and shaped to slide over body portion 16 and to form a snug fit with respect to body portion 16.

Figure 2:
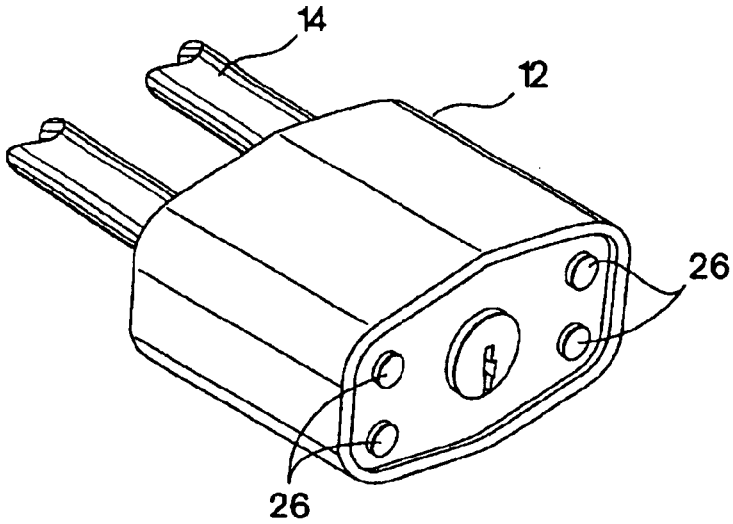
FIG. 2 is an isometric diagram that illustrates the bottom face of the padlock with the security jacket in place according to an embodiment of the present invention.
Figure 3:
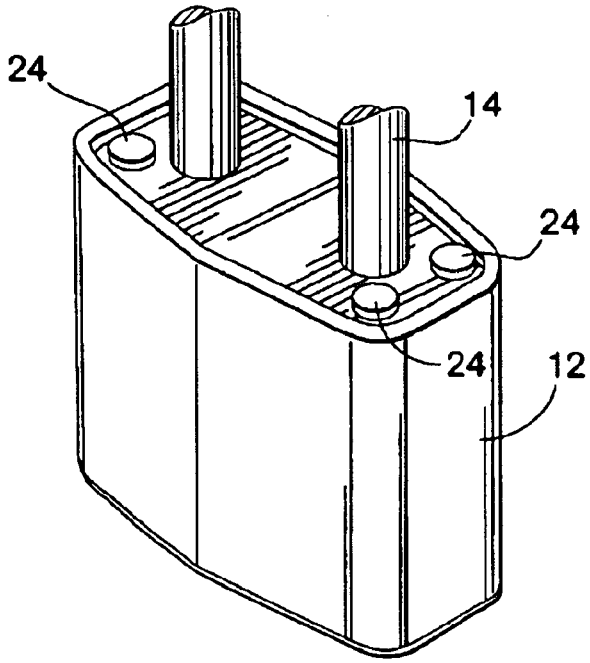
FIG. 3 is an isometric diagram that illustrates the top face of the padlock with the security jacket in place according to an embodiment of the present invention.

FIG. 2 shows padlock 10 with jacket 12 in place. As shown, jacket 12 extends beyond distal ends 26 to protect body pins 20 from a forced attack on distal ends 26. Similarly, FIG. 3 shows jacket 12 extending beyond proximal ends 24 to protect body pins 20 from a forced attack on proximal ends 24.

Figure 4:
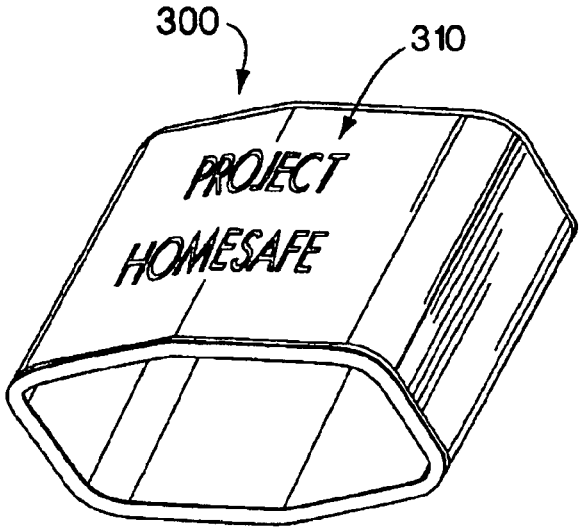
FIG. 4 is an isometric illustration of a sleeve that covers the jacket according to an embodiment of the present invention.
Figure 5:
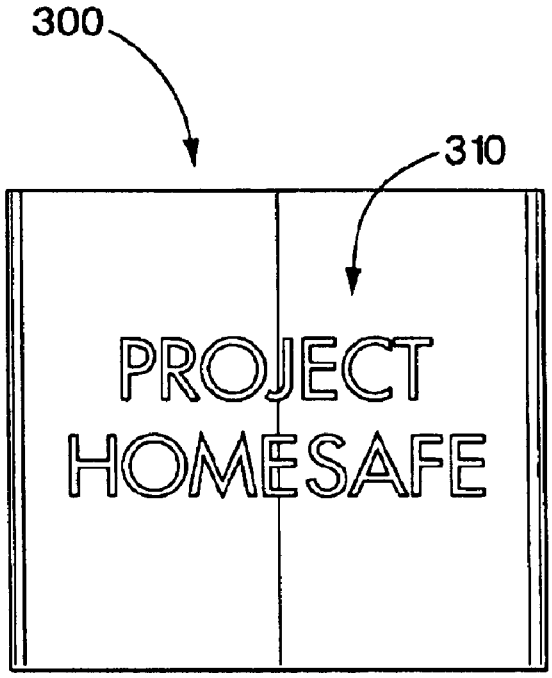
FIG. 5 is a front view of a sleeve that covers the jacket according to an embodiment of the present invention.
Figure 6:
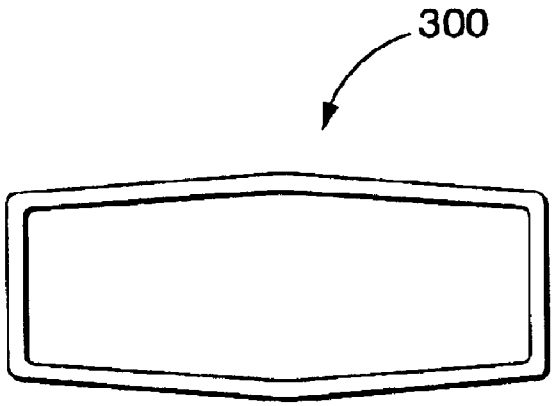
FIG. 6 is a top view of a sleeve that covers the jacket according to an embodiment of the present invention.

FIG. 4 is an isometric illustration of a sleeve 300 that covers jacket 12 according to an embodiment of the present invention. Sleeve 300 may be an endless strip of flexible material, such as vinyl, nylon, or plastic, which slips over and snugly envelopes jacket 12. A method for manufacturing the sleeve may include, for example, cutting the sleeve from an extruded tube of such a flexible material. According to another embodiment, the sleeve may exhibit an imprint 310 thereon, such as by hot stamping, that, for example, deters tampering or identifies an individual having responsibility for padlock 10. FIG. 5 and FIG. 6 show front and top views, respectively, of sleeve 300 according to an embodiment of the present invention.

Figure 7:
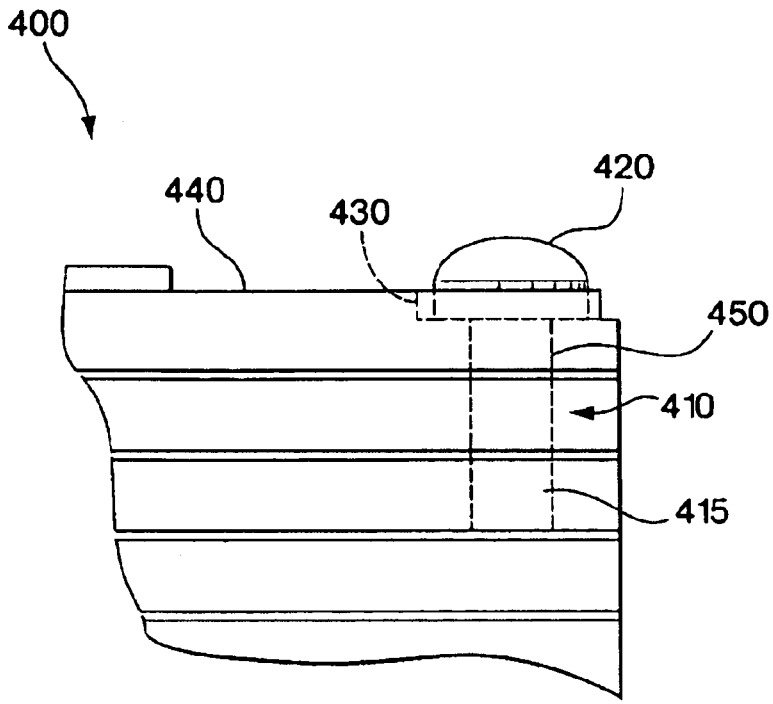
FIG. 7 is a vertical cross section of a padlock according to an embodiment of the present invention.

FIG. 7 illustrates a padlock 400 according to another embodiment of the present invention. FIG. 7 is a vertical cross section of padlock 400 that includes a body pin 410 having a shaft 415 and an enlarged head 420, a top surface 440, an opening 450, and a countersink area 430 in top surface 440. Countersink 430 is adapted to receive enlarged head 420. More specifically, countersink 430 has a diameter greater than the diameter of enlarged head 420 at its widest point. According to this embodiment, countersink 430 has a rectangular cross-section and is adapted to be engaged by enlarged head 420 of body pin 410 such that head 420 projects partially above top surface 440 to protect padlock 400 from attack. Other embodiments may incorporate a full circle countersink, such as for padlocks constructed of steel, but the enlarged head need not be recessed entirely to protect the body pins from attack.

Figure 8:
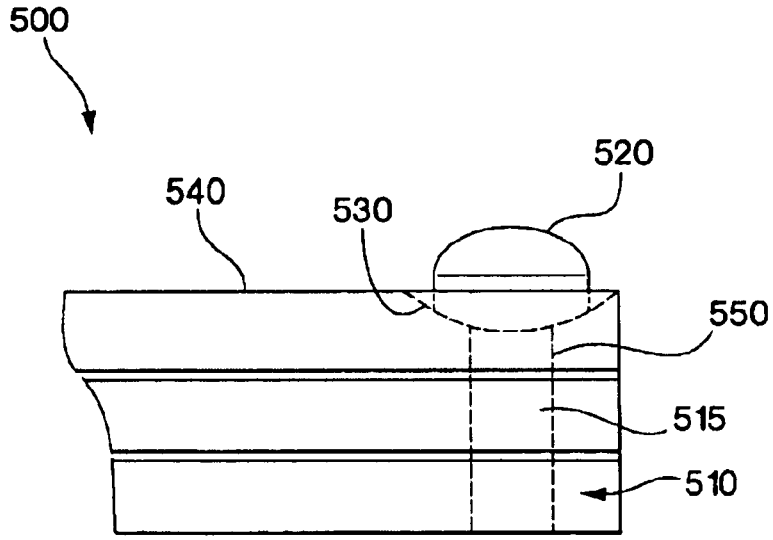
FIG. 8 is a vertical cross section of a padlock according to an embodiment of the present invention.
Figure 9:
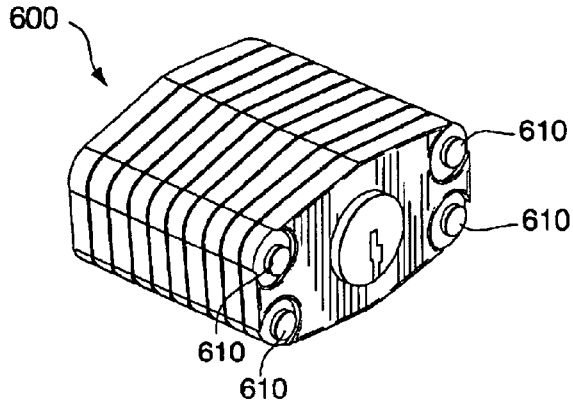
FIG. 9 is an isometric diagram that illustrates the bottom face of the padlock with countersunk body pins according to an embodiment of the present invention.
Figure 10:
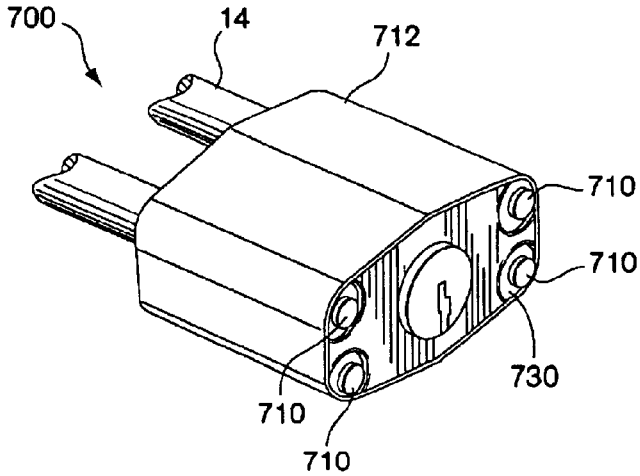
FIG. 10 is an isometric diagram of the padlock assembly, similar to that shown in FIG. 2, with countersunk body pins according to an embodiment of the present invention.

FIG. 8 illustrates a padlock 500 according to another embodiment of the present invention. FIG. 8 is a vertical cross section of padlock 500 that includes a body pin 510 having a shaft 515 and an enlarged head 520, a countersink 530, a top surface 540, and an opening 550. Padlock 500 is similar to padlock 400 illustrated in FIG. 7 except that countersink 530 is conically tapered to be engaged by enlarged head 520. In general, body pin 510 may geometrically complement countersink 530. Like padlock 400, enlarged head 520 projects partially above top surface 540 to protect padlock 500 from attack. FIG. 9 is a pictorial view of a padlock 600 according to another embodiment of the present invention. Padlock 600 is similar to padlock 400 illustrated in FIG. 7 except that body pins 610 have flat heads. FIG. 10 shows another embodiment of the present invention in which a padlock assembly 700 having a jacket 712, similar to that shown in FIG. 2, also includes the use of countersinks 730 to protect body pins 710.

Those of ordinary skill in the art will appreciate that other countersink cross-sections may be used without departing from the principles of the present invention. Those of ordinary skill in the art will also appreciate that principles described with respect to protecting top surface 440 of padlock 400, shown in FIG. 7, are equally applicable to a bottom surface with respect to penetrating body pins.

Figure 11:
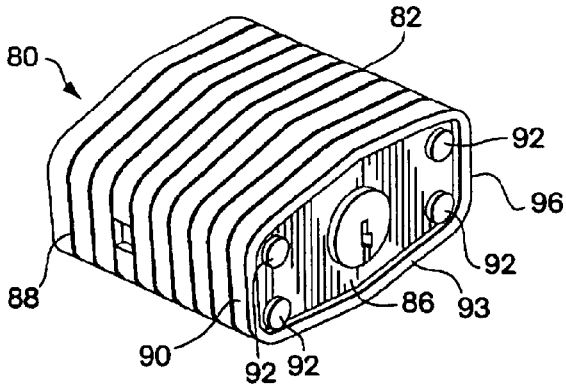
FIG. 11 illustrates a padlock having a bottom face according to an embodiment of the present invention.

FIG. 11 illustrates a padlock 80 that includes a padlock body portion 82 having a top face 84 (not visible) and a bottom face 86 according to an embodiment of the present invention. According to such an embodiment, padlock body portion 82 is comprised of a plurality of body plates, including a top plate 88 and a bottom plate 90. Cylindrical body pins 92 may penetrate and extend through top and bottom plates 88 and 90 to secure the body plates. Bottom face 86 may include a flange 93 having an edge 96 around its perimeter to prevent access to body pins 92. Although not shown, top plate 88 can include a similar flange arrangement.

It can thus be appreciated that while the invention has been particularly shown and described with respect to preferred embodiments thereof, it will be understood by those skilled in the art that changes in form and details may be made therein without departing from the scope and spirit of the invention.

What is claimed is:

1. A padlock assembly comprising:

a padlock including a lock body and a shackle, the lock body having a top surface and a bottom surface and at least one body pin having a longitudinal dimension and extending through the lock body and beyond the top surface and the bottom surface, the shackle being fixedly attachable to the lock body through the top surface; and a jacket comprising a hollow member shaped to receive the lock body and fixedly attached to the lock body, the jacket having a length at least as great as the longitudinal dimension of the at least one body pin, the jacket being disposed on the lock body to extend beyond the top surface and the bottom surface coextensive with the at least one body pin.

2. The padlock assembly of claim 1 wherein the jacket comprises hardened steel.

3. The padlock assembly of claim 1 wherein the jacket is secured to the padlock by inwardly crimping the jacket against the lock body.

4. The padlock assembly of claim 3 wherein the padlock includes a prefabricated cavity in which to receive the crimping of the jacket.

5. The padlock assembly of claim 1 further comprising securing means for securing the jacket to the padlock.

6. The padlock assembly of claim 1 wherein the shackle is a cable.

7. The padlock assembly of claim 1 wherein the longitudinal dimension of the hollow member is approximately equal to the longitudinal dimension of the at least one body pin.

8. The padlock assembly of claim 1 wherein the longitudinal dimension of the hollow member is greater than the longitudinal dimension of the at least one body pin.

9. The padlock assembly of claim 1 wherein the at least one body pin is at least partially countersunk with respect to the top surface.

10. The padlock assembly of claim 1 wherein the at least one body pin is at least partially countersunk with respect to the bottom surface.

11. The padlock assembly of claim 1 further comprising a sleeve adapted to receive the padlock and the jacket.

12. The padlock assembly of claim 11 wherein the sleeve includes a label printed thereon.

13. The padlock assembly of claim 11 wherein the sleeve comprises at least one of latex, vinyl, or plastic.

14. A padlock assembly comprising:

a padlock including a lock body and a shackle, the lock body having a surface and at least one body pin having a longitudinal dimension and extending through the lock body and beyond the surface, the shackle being fixedly attachable to the lock body; and a jacket comprising a hollow member shaped to receive the lock body and fixedly attached to the lock body, the jacket having a length at least as great as the longitudinal dimension of the at least one body pin, the jacket being disposed on the lock body to extend beyond the surface coextensive with the at least one body pin.

15. The padlock assembly of claim 14 wherein the jacket comprises hardened steel.

16. The padlock assembly of claim 14 wherein the at least one body pin is at least partially countersunk with respect to the surface.

17. The padlock assembly of claim 14 wherein the shackle is a cable.

18. A padlock comprising:

a lock body having a surface that includes a perimeter flange having an edge;

a shackle fixedly attachable to the lock body; and at least one body pin extending through the lock body and beyond the surface but not beyond the edge of the perimeter flange.

19. The padlock of claim 18 wherein the perimeter flange is fixedly attached to a plate and the plate is fixedly attachable to the lock body.

20. The padlock assembly of claim 18 wherein the at least one body pin is at least partially countersunk with respect to the surface.

* * * * *